US009476209B2

(12) United States Patent
Dupuis et al.

(10) Patent No.: US 9,476,209 B2
(45) Date of Patent: Oct. 25, 2016

(54) DRYWALL TAPE DISPENSER ACTUATED USING A DRILL

(71) Applicants: Nico Dupuis, Blainville (CA); Michel Daraiche, Mirabel (CA)

(72) Inventors: Nico Dupuis, Blainville (CA); Michel Daraiche, Mirabel (CA)

( * ) Notice: Subject to any disclaimer, the term of this patent is extended or adjusted under 35 U.S.C. 154(b) by 202 days.

(21) Appl. No.: 14/449,253

(22) Filed: Aug. 1, 2014

(65) Prior Publication Data

US 2016/0032599 A1 Feb. 4, 2016

(51) Int. Cl.
*B65H 20/02* (2006.01)
*E04F 21/165* (2006.01)

(52) U.S. Cl.
CPC ..... *E04F 21/1657* (2013.01)

(58) Field of Classification Search
CPC ..... E04F 21/1657; B65H 75/305; B65H 16/005; B65H 16/103
USPC ..... 242/564, 564.3–564.5; 118/43, 122, 118/123, 405
See application file for complete search history.

(56) References Cited

U.S. PATENT DOCUMENTS

| | | | | |
|---|---|---|---|---|
| 834,087 | A | 10/1906 | Vogt | |
| 2,319,639 | A | 5/1943 | Simpson | |
| 2,348,166 | A | 5/1944 | Cavanaugh et al. | |
| 2,458,297 | A * | 1/1949 | Petty | B05C 3/125 118/122 |
| 2,876,730 | A | 3/1959 | Moore | |
| 3,112,225 | A * | 11/1963 | Harms | E04F 21/165 118/123 |
| 3,344,770 | A | 10/1967 | Schaeffer | |
| 3,496,909 | A | 2/1970 | Bennett, Jr. | |
| 4,202,288 | A * | 5/1980 | Davy, Jr. | B44C 7/04 118/123 |
| 4,660,502 | A | 4/1987 | Scott | |
| 4,775,442 | A * | 10/1988 | Januska | B44C 7/04 156/465 |
| 4,996,941 | A * | 3/1991 | Mills | E04F 21/165 118/419 |
| 5,908,137 | A * | 6/1999 | Pattarozzi | A47K 10/36 221/45 |
| 2003/0098383 | A1 * | 5/2003 | Luo | B23K 9/1333 242/559 |

FOREIGN PATENT DOCUMENTS

| | | |
|---|---|---|
| DE | 913353 | 6/1954 |
| FR | 2619798 | 3/1989 |
| FR | 2964578 | 3/2012 |

* cited by examiner

*Primary Examiner* — William Gilbert

(57) ABSTRACT

A drywall tape dispenser actuated using a drill has an "L" shaped member having a top cross piece, an elongated side piece, and an elbow portion therebetween thereby forming an L-shape, a first spindle member at a bottom portion of the elongated side piece, a second spindle member at a top portion of the elongated side piece and within the elbow portion, and a third spindle member between the first and second spindle members. An active pressure roller rotatably attached to a distal end section of the top cross piece opposite the elbow portion adapted to press on a surface portion of tape passing thereby. A passive pressure roller rotatably attached to the distal end section of the top cross piece opposite the elbow portion and spaced from the active pressure roller and adapted to press on an opposite surface portion of the tape passing thereby, such that the active pressure roller and the passive pressure roller are adapted to pinch the tape passing therethrough.

11 Claims, 3 Drawing Sheets

18'''
20
30
12
26
13
22
15
17
16
14
18''
10
24
19
18
18'

DRYWALL TAPE DISPENSER ACTUATED USING A DRILL

This application claims priority based on request GB1314424.1 filed Aug. 12, 2013

FIELD OF THE INVENTION

The present invention relates generally to drywall tools but more particularly to a drywall tape dispenser actuated using a drill.

BACKGROUND OF THE INVENTION

Drywalling requires putting tape on all the joints. There are different methods that have been used over the years. One consists in applying wet plaster over the joints and then pressing a dry paper ribbon over and removing excess plaster with a trowel. Another technique involves getting the tape saturated with wet plaster so that it can be applied over the joints in a single operation. Both methods are rather tedious and can be quite messy. There is a need for a better way to do this job.

SUMMARY OF THE INVENTION

In view of the foregoing disadvantages inherent in the known devices now present in the prior art, the present invention, which will be described subsequently in greater detail, is to provide objects and advantages which are:

To provide for a quick and simple method of applying a dry ribbon over a plastered joint.

In order to do so, the invention has an "L" shaped member having a top cross piece, an elongated side piece, and an elbow portion therebetween thereby forming an L-shape, a first spindle member at a bottom portion of the elongated side piece, a second spindle member at a top portion of the elongated side piece and within the elbow portion, and a third spindle member between the first and second spindle members.

An active pressure roller rotatably attached to a distal end section of the top cross piece opposite the elbow portion adapted to press on a surface portion of tape passing thereby. A passive pressure roller rotatably attached to the distal end section of the top cross piece opposite the elbow portion and spaced from the active pressure roller and adapted to press on an opposite surface portion of the tape passing thereby, such that the active pressure roller and the passive pressure roller are adapted to pinch the tape passing therethrough.

A sub-frame connector member attached to and extending outwardly from the elongated side piece and parallel to the top cross piece, and including a tape holding member adapted to rotatably hold a roll of tape thereon. A drill connector attached to the active pressure roller and adapted to connect to a drill member, such that the drill member can rotate the active pressure roller, such that when the tape is looped around the second spindle member, then down and around and up from the first spindle member, then around the third spindle member, and then between the active and passive pressure rollers, the tape is dispensed from the dispenser and onto a chosen surface.

Preferably, a distal end of the sub-frame connector member spaced from the side piece of the "L" shaped member is connected to the distal end section of the top cross piece by an elongated sub-frame connector member.

The "L" shaped member and the sub-frame connector member are both formed using elongated, flat, spaced parallel frame portions, to thereby provide space within the "L" shaped members for the spindle members and the tape to pass therethrough.

In a preferred embodiment, the drywall tape dispenser is further comprised of a fourth spindle member located at the distal end of the top cross piece, and adapted to guide the tape into and through the active and passive pressure rollers.

The active pressure roller is rotatably attached to the distal end section of the top cross piece via at least one spring biased arm, and at least one spring member attached between each the at least one spring biased arm, such that pressure is applied between the active and passive pressure rollers to thereby be adapted to pull the tape therebetween and therethrough when the drill connector is rotated by the drill member.

In yet another preferred embodiment, there are two spring biased arms respectively attached to opposite sides of the active pressure roller and to the distal end of the top cross piece.

The passive pressure roller is connected to the distal end section of the top cross piece by an elongated passive pressure roller connector member, to thereby position the passive pressure roller such that the tape is adapted to pass between and through the active and passive pressure rollers in a direction that allows the tape to contact be directed by the fourth spindle member before being dispensed from the dispenser.

Preferably, the tape holding member is removably attached to the sub-frame member by being formed in a nut and bolt configuration, such that when the tape runs out a new roll of tape can be easily inserted into the tape dispenser.

The dispenser is formed from a list of non-corrosive materials comprising stainless steel, plastic, and composite plastics.

The drywall tape dispenser is used in combination with a roll of tape and a drill member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
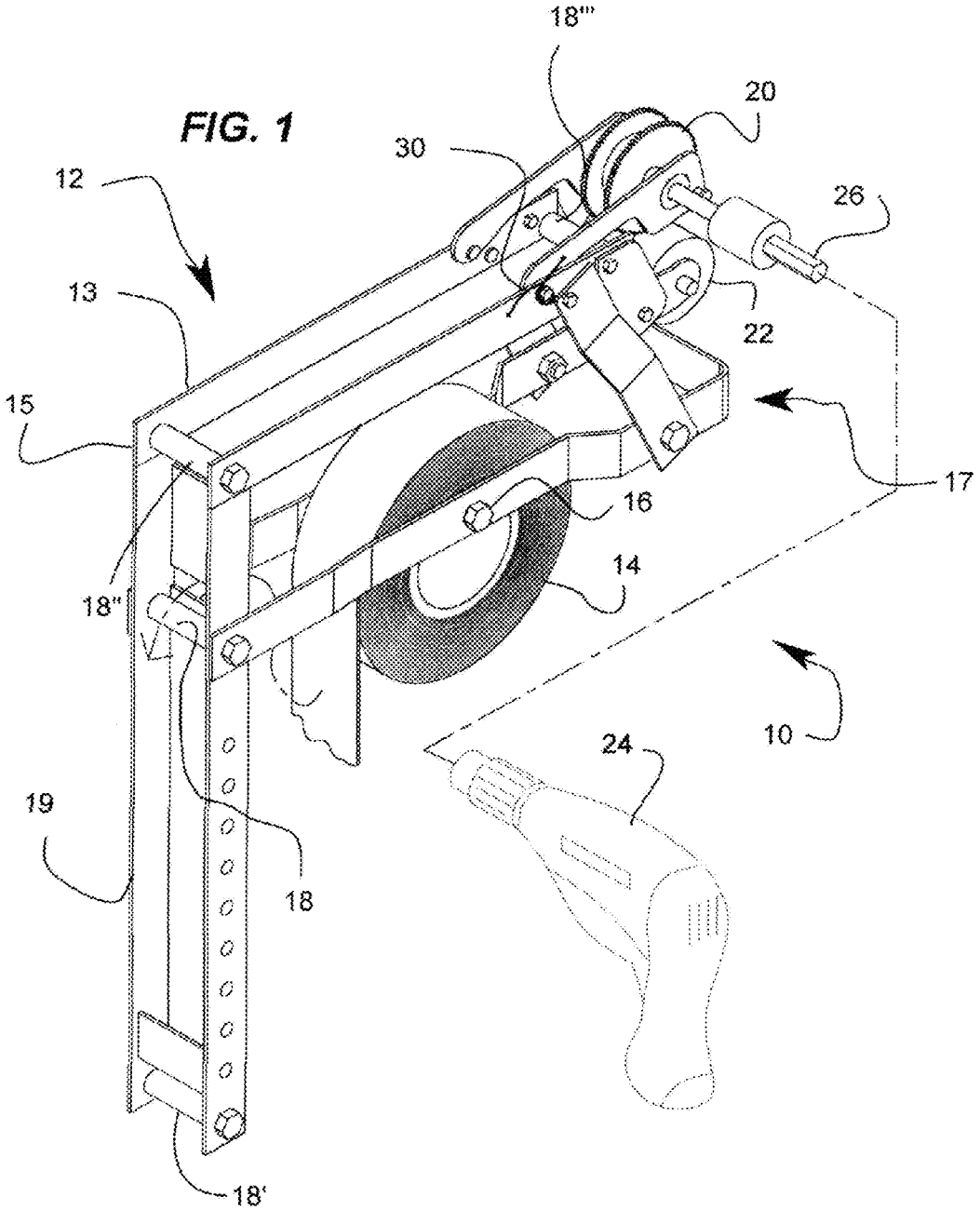
FIG. 1 Isometric view of the invention.
Figure 2A:
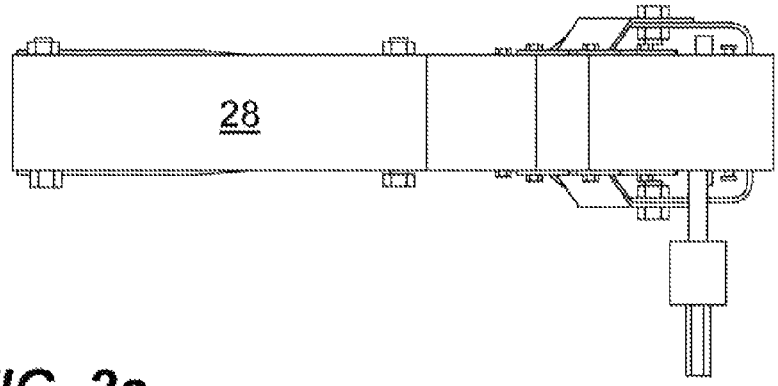
FIGS. 2*a-b* Top and side views of the invention.
Figure 2B:
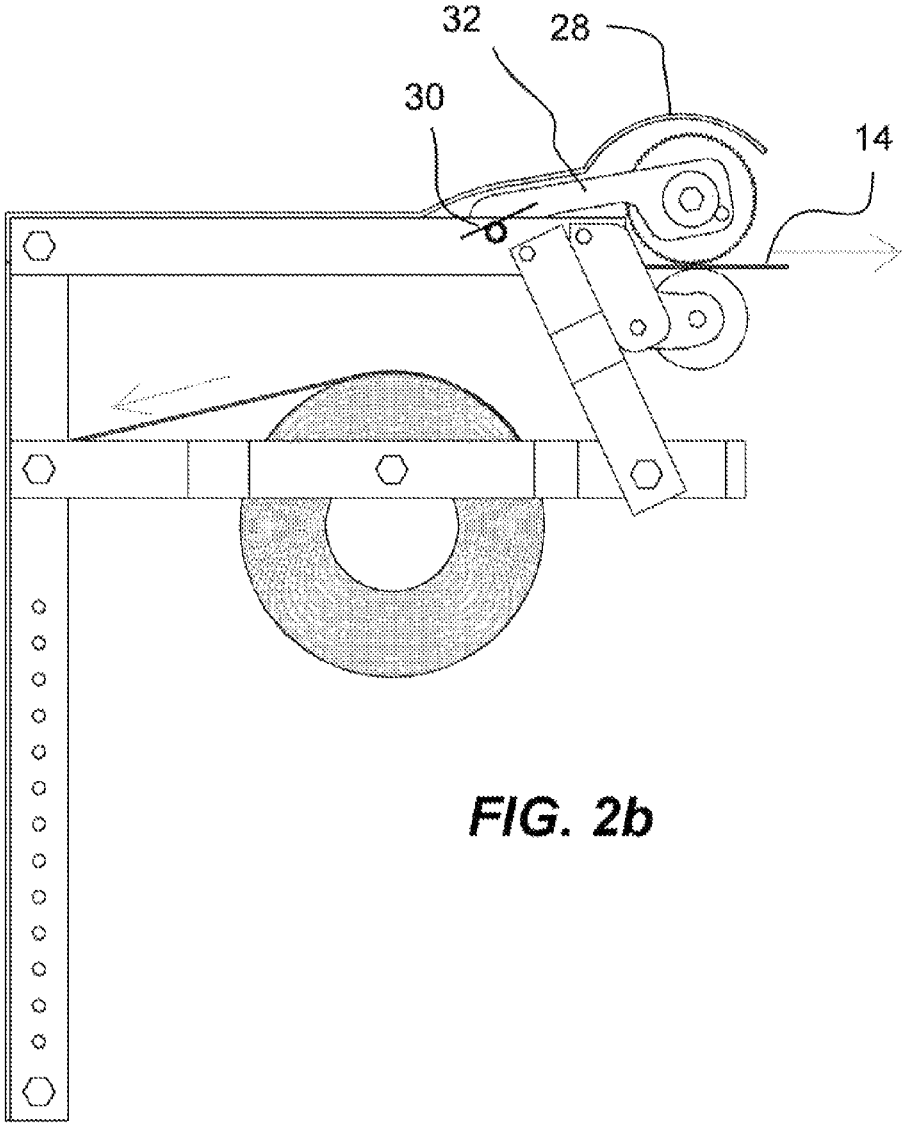
Figure 3:
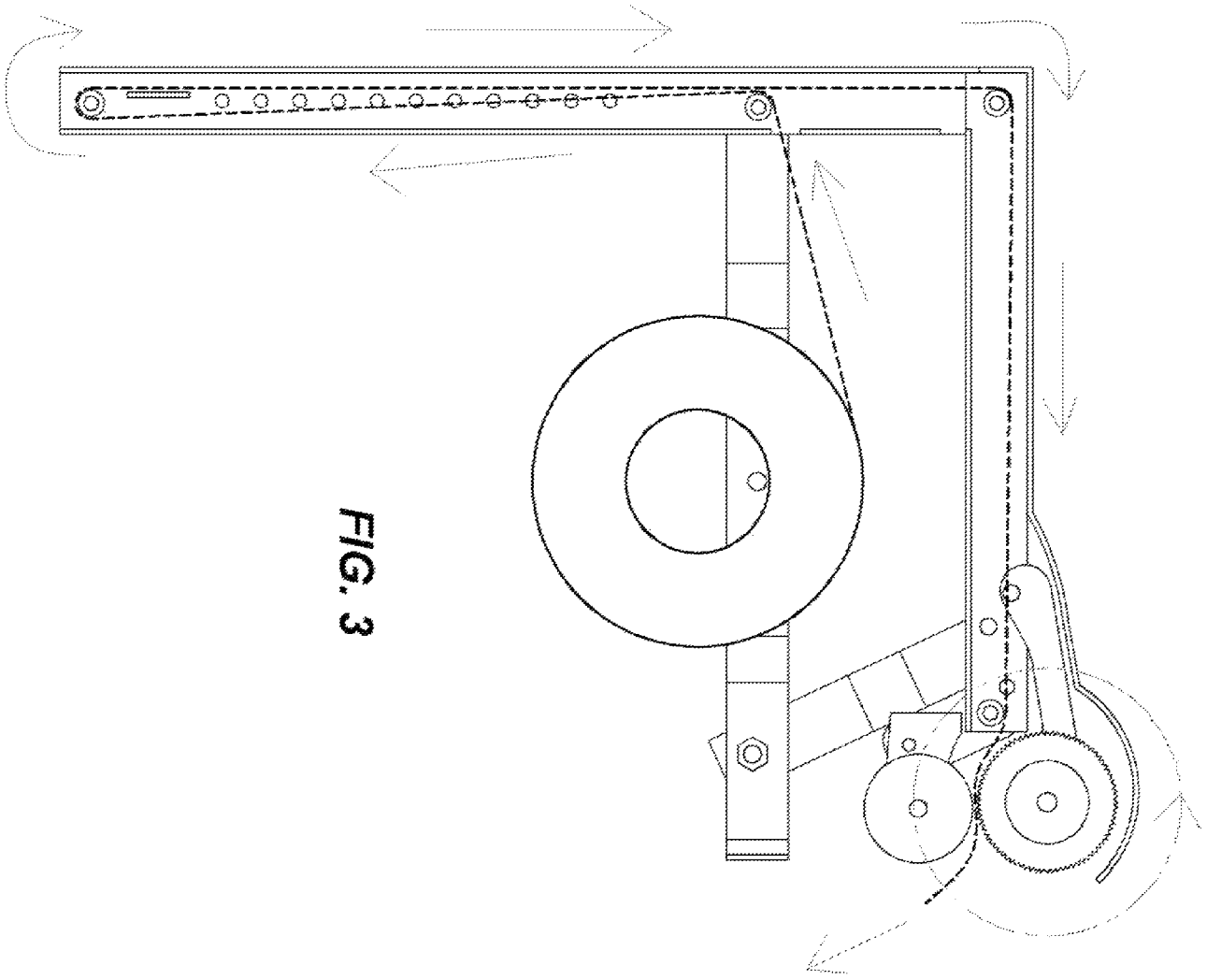
FIG. 3 Side view showing the path and direction of the tape.

A drywall tape dispenser (10) has an "L" shaped member (12) consisting of a top cross piece (13), an elongated side piece (15), and an elbow portion (19) therebetween thereby forming an L-shape. A tape holding member (16) onto which is installed a roll of tape (14). The tape (14) is dispensed over first, second, third, and fourth spindle members (18, 18', 18", 18''') forming part of the "L" shaped member (12). The tape (14) then passes between an active pressure roller (20) and a passive pressure roller (22). The active pressure roller (20) is actuated by a drill (24) by way of a drill connector (26). The tape holding member (16) is itself being held by a sub-frame connector member (17) which is fixedly attached to the "L" shaped member (12).

The tape dispenser (10) is held by a user who moves it in such a way that the passive pressure roller (22) rolls over a joint so that the tape (14), exiting between both the active and passive rollers (20, 22), can be applied. The "L" shaped member (12) and the sub-frame connector member (17) are both formed using elongated, flat, spaced parallel frame portions, to thereby provide space for the spindle members (18, 18', 18") and the tape (14) to pass therethrough.

Other parts include a cover member (28) to protect the tape (14) from falling plaster. At least one spring (30) to apply pressure between the two pressure roller (20, 22).

The active pressure roller (20) connects with the spring (30) by way of a lever arm member (32) which is designed to be axially movable around an axis defined by the location of the coiled section of the spring (30). This ensures that a constant pressure is applied by the active roller (20) onto the passive roller (22) such that the tape (14) can be pulled through.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A drywall tape dispenser comprising an "L" shaped member having a top cross piece, an elongated side piece, and an elbow portion therebetween thereby forming an L-shape, a first spindle member is located at a point on said elongated side piece, in between a second spindle member located at a bottom portion of said elongated side piece and a third spindle located within said elbow portion; an active pressure roller rotatably attached to a distal end section of said top cross piece opposite said elbow portion adapted to press on a surface portion of tape passing thereby; a passive pressure roller rotatably attached to said distal end section of said top cross piece opposite said elbow portion and spaced from said active pressure roller and adapted to press on an opposite surface portion of said tape passing thereby, such that said active pressure roller and said passive pressure roller are adapted to pinch said tape passing therethrough; a sub-frame member attached to and extending outwardly from said elongated side piece and parallel to said top cross piece, and including a tape holding member adapted to rotatably hold a roll of tape thereon; and a drill connector attached to said active pressure roller and adapted to connect to a drill member, such that said drill member can rotate said active pressure roller, such that when said tape is looped around said first spindle member, then said second spindle member, then around said third spindle member, and then between said active and passive pressure rollers, said tape is dispensed from said dispenser and onto a chosen surface.

2. The drywall tape dispenser of claim 1, wherein a distal end of said sub-frame member spaced from said side piece of said "L" shaped member is connected to said distal end section of said top cross piece by an elongated sub-frame connector member.

3. The drywall tape dispenser of claim 1, wherein said "L" shaped member and said sub-frame connector member are both formed using elongated, flat, spaced parallel frame portions, to thereby provide space within said "L" shaped members for said spindle members and said tape to pass therethrough.

4. The drywall tape dispenser of claim 3, wherein said tape holding member is removably attached to said sub-frame member by being formed in a nut and bolt configuration, such that when said tape runs out a new roll of tape can be easily inserted into said tape dispenser.

5. The drywall tape dispenser of claim 1, further comprising a fourth spindle member located at said distal end of said top cross piece, and adapted to guide said tape into and through said active and passive pressure rollers.

6. The drywall tape dispenser of claim 5, wherein said passive pressure roller is connected to said distal end section of said top cross piece by an elongated passive pressure roller connector member, to thereby position said passive pressure roller such that said tape is adapted to pass between and through said active and passive pressure rollers in a direction that allows said tape to contact be directed by said fourth spindle member before being dispensed from said dispenser.

7. The drywall tape dispenser of claim 1, wherein said active pressure roller is rotatably attached to said distal end section of said top cross piece via at least one spring biased arm, and at least one spring member attached between each said at least one spring biased arm, such that pressure is applied between said active and passive pressure rollers to thereby be adapted to pull said tape therebetween and therethrough when said drill connector is rotated by said drill member.

8. The drywall tape dispenser of claim 7, wherein there are two spring biased arms respectively attached to opposite sides of said active pressure roller and to said distal end of said top cross piece.

9. The drywall tape dispenser of claim 1, wherein said dispenser is formed from a list of non-corrosive materials comprising stainless steel, plastic, and composite plastics.

10. A combination of a drywall tape dispenser and a roll of tape, said combination comprising a roll of tape; and said drywall tape dispenser comprising an "L" shaped member having a top cross piece, an elongated side piece, and an elbow portion therebetween thereby forming an L-shape, a first spindle member is located at a point on said elongated side piece, in between a second spindle member located at a bottom portion of said elongated side piece and a third spindle located within said elbow portion; an active pressure roller rotatably attached to a distal end section of said top cross piece opposite said elbow portion adapted to press on a surface portion of said tape passing thereby; a passive pressure roller rotatably attached to said distal end section of said top cross piece opposite said elbow portion and spaced from said active pressure roller and adapted to press on an opposite surface portion of said tape passing thereby, such that said active pressure roller and said passive pressure roller are adapted to pinch said tape passing therethrough; a sub-frame connector member attached to and extending outwardly from said elongated side piece and parallel to said top cross piece, and including a tape holding member adapted to rotatably hold said roll of tape thereon; and a drill connector attached to said active pressure roller and adapted to connect to a drill member, such that said drill member can rotate said active pressure roller, such that when said tape is looped around said first spindle member, then said second spindle member, then around said third spindle member, and then between said active and passive pressure rollers, said tape is dispensed from said dispenser and onto a chosen surface.

11. A combination of a drill member, a drywall tape dispenser, and a roll of tape, said combination comprising a drill member; a roll of tape; and said drywall tape dispenser comprising an "L" shaped member having a top cross piece, an elongated side piece, and an elbow portion therebetween thereby forming an L-shape, a first spindle member is located at a point on said elongated side piece, in between a second spindle member located at a bottom portion of said elongated side piece and a third spindle located within said elbow portion; an active pressure roller rotatably attached to a distal end section of said top cross piece opposite said elbow portion adapted to press on a surface portion of said tape passing thereby; a passive pressure roller rotatably attached to said distal end section of said top cross piece opposite said elbow portion and spaced from said active pressure roller and adapted to press on an opposite surface portion of said tape passing thereby, such that said active pressure roller and said passive pressure roller are adapted to pinch said tape passing therethrough; a sub-frame connector member attached to and extending outwardly from said elongated side piece and parallel to said top cross piece, and including a tape holding member adapted to rotatably hold said roll of tape thereon; and a drill connector attached to said active pressure roller and adapted to connect to said drill member such that said drill member can rotate said active pressure roller, such that when said tape is looped around said said first spindle member, then said second spindle member, then around said third spindle member, and then between said active and passive pressure rollers, said tape is dispensed from said dispenser and onto a chosen surface.

* * * * *